US007681751B2

(12) United States Patent
Hilders

(10) Patent No.: US 7,681,751 B2
(45) Date of Patent: Mar. 23, 2010

(54) COLLAPSIBLE CONTAINER FOR THE TRANSPORT OF AIR CARGO

(75) Inventor: Hendricus Gerardus Hilders, Amsterdam (NL)

(73) Assignee: Cargobox Holding B.V., Amsterdam (NL)

( * ) Notice: Subject to any disclaimer, the term of this patent is extended or adjusted under 35 U.S.C. 154(b) by 1192 days.

(21) Appl. No.: 10/486,045

(22) PCT Filed: Jul. 9, 2002

(86) PCT No.: PCT/NL02/00447

§ 371 (c)(1),
(2), (4) Date: Aug. 19, 2004

(87) PCT Pub. No.: WO03/035492

PCT Pub. Date: May 1, 2003

(65) Prior Publication Data

US 2005/0000961 A1 Jan. 6, 2005

(30) Foreign Application Priority Data

Aug. 9, 2001 (NL) ..... 1018731

(51) Int. Cl.
*B65D 6/24* (2006.01)

(52) U.S. Cl. ..... 220/4.32

(58) Field of Classification Search ..... 220/4.32, 220/4.28

See application file for complete search history.

(56) References Cited

U.S. PATENT DOCUMENTS 1,177,847 A * 4/1916 Bosworth et al. ..... 220/4.28
1,484,789 A 2/1924 Lackey
3,266,656 A * 8/1966 Kridle ..... 220/4.28
4,139,113 A 2/1979 Graham, Jr. ..... 217/12 R
5,803,295 A 9/1998 Tussey ..... 220/4.31

FOREIGN PATENT DOCUMENTS

WO WO 00 59789 10/2000
WO WO 01 05668 1/2001

* cited by examiner

*Primary Examiner*—Stephen J. Castellano
(74) *Attorney, Agent, or Firm*—Steven M. Koehler; Westman, Champlin & Kelly, P.A.

(57) ABSTRACT

What is disclosed is a collapsible container for the transport of air cargo, consisting of a bottom panel, a cover panel and four side walls which are detachably connected to said bottom panel and said cover panel, wherein the bottom panel and the cover panel adjoin each other in the collapsed position of the container, retaining the four side walls between them. The bottom panel is provided with profiled members at two opposed first edges, which profiled members can be inserted into complementary profiled members at two corresponding opposed first edges of the cover panel by moving said profiled members in longitudinal direction relative to each other, and two first opposed side walls are provided with profiled members at their horizontal edges, which profiled members are complementary to the corresponding first opposed edges, which profiled members can be inserted into complementary profiled members at the corresponding vertical side walls by moving said profiled members in longitudinal direction relative to each other.

19 Claims, 3 Drawing Sheets

COLLAPSIBLE CONTAINER FOR THE TRANSPORT OF AIR CARGO

CROSS-REFERENCE TO RELATED APPLICATION

This Application is a Section 371 National Stage Application of International Application No. NL02/00447, filed and published as WO 03/035942 on, 9 Jul. 2002 in English.

BACKGROUND OF THE INVENTION

The invention relates to a collapsible container for the transport of air cargo, consisting of a bottom panel, a cover panel and four side walls which are detachably connected to said bottom panel and said cover panel, wherein the bottom panel and the cover panel adjoin each other in the collapsed position of the container, retaining the four side walls between them.

In a fully unfolded position, such a container has a certain transport volume, which will generally be adapted to the standard dimensions of the cargo space of an aeroplane. When the container is not being used, it can be collapsed, in which position the bottom panel and the cover panel adjoin each other, retaining the four side walls between them. In this collapse position, the container has a minimum transport volume. A known container of the type to which the present invention relates is disclosed in international patent application WO 01/05668.

SUMMARY OF THE INVENTION

It is an object of the present invention to further improve a collapsible container of the present type.

In order to accomplish that objective, the collapsible container according to the invention is includes:

- a bottom panel that is provided with profiled members at two opposed first edges, which profiled members can be inserted into complementary profiled members at two corresponding opposed first edges of the cover panel by moving said profiled members in longitudinal direction relative to each other;
- two first opposed side walls that are provided with profiled members at their horizontal edges, which profiled members are complementary to the corresponding profiled members of the bottom panel and the cover panel, and in that said first opposed side walls are provided with profiled members at their vertical edges, which profiled members can be inserted into complementary profiled members at the corresponding vertical edges of two second opposed side walls by moving said profiled members in longitudinal direction relative to each other.

In the fully collapsed position, in which the four side walls are retained between the bottom panel and the cover panel, the bottom panel engages into the complementary profiled members of the cover panel with the aforesaid profiled members. Said joining of the bottom panel and the cover panel takes place by moving the two panels relative to each other. When the container is to be brought into its fully unfolded position (i.e. the position of use), the bottom panel is slid out of the cover panel, after which the profiled members of the two first side walls are slid into the profiled members at the first edges of the bottom panel. Then the profiled members at the vertical edges of the second side walls are slid into the profiled members of the vertical edges of the first side walls. Finally, the cover panel can be slid into the upper horizontal profiled members of the first side walls, so that the container is in principle ready for use.

It is noted within the framework of this invention that the term "collapsible" does not mean that the container comprises parts that can be folded about hinges. The term is only used to indicate that the container can be moved from a position in which it takes up relatively little space (the "collapsed position") to a position in which it takes up a large volume (the "unfolded position").

As a result of the mating interaction between complementary profiled members (in which longitudinal movements between adjoining parts take place), the transition of the collapsible container from one position to the other position can take place in an extremely quick and simple manner. Special tools are not required, nor is specialist knowledge on the part of the user.

In a preferred embodiment of the container according to the invention, locking devices are used for interlocking the component parts of the container in the fully collapsed position (engagement between corresponding profiled members of the bottom panel and the cover panel) or in the fully unfolded position (engagement between corresponding profiled members of the bottom panel and the cover panel and of the first side walls and engagement between corresponding profiled members of the first and the second side walls).

As a result of the use of such locking devices, the contents (air cargo) of the container are protected against theft in the fully unfolded position thereof. Only authorized persons can remove the locking devices. Such a locking devices can serve a useful purpose in the collapsed position of the container as well, since it can prevent theft of parts of the container.

Such locking devices can be realised in that the bottom panel on the one hand and a corresponding second side wall on the other hand are provided with identical profiled members at one of the second edges and at the horizontal edge facing away from the bottom panel, respectively, whilst the cover panel is likewise provided with a profiled member at a corresponding second edge, wherein a locking strip comprising corresponding, complementary profiled members can be inserted into the aforesaid profiled members of the bottom panel and the cover panel (in the collapsed position), or into the aforesaid profiled members of said second side wall and the cover panel (in the unfolded position), which locking strip is fitted with a locking mechanism for locking the locking strip in its inserted position.

After the cover panel has been slid onto the bottom panel in the above-described manner, or after the cover panel has been combined with the bottom panel, with the interposition of the four side walls, into a container, the locking strip is finally inserted into said profiled members, thus functioning as a closing member, as it were. The locking strip, when fitted, prevents the cover panel being moved with respect to the bottom panel for disassembly of the container. The locking strip itself is secured against being removed by the aforesaid locking mechanism.

The locking of the locking strip can take place in an advantageous manner, in that the locking mechanism comprises a locking pin to be operated by a key, which, in a locking position, effects a connection between the locking strip and an adjacent part of the container. Movement of the locking strip with respect to an adjacent part of the container is not possible in a locking position of the locking pin, so that the cover panel cannot be moved with respect to the bottom panel (or with respect to the side walls) for the purpose of disassembling the container, either. The locking strip cannot be removed until the locking pin has been moved to a releasing position by means of the key, after which the cover panel and possibly the side walls can be moved apart, thus making it possible to disassemble the container and, if desired, bring it into the collapsed position.

The aforesaid key, and consequently the locking mechanism, may be designed as an entirely mechanical unit, but also as an entirely or partially electric or electronic unit. The use of a smart chip with all the possibilities it provides is within the bounds of the possible. In this connection, the integration of a follow function, in which the position of the container can be established at all times, for example via GPS, may be considered.

In the foregoing, the use of mating profiled members being movable in longitudinal direction relative to each other has been discussed. According to another possibility, however, the cover panel is provided with a profiled member at its rear second edge (seen in the direction of movement for unfolding), which profiled member is capable of hooked engagement of a corresponding profiled member of the bottom panel or of the upper horizontal edge of the corresponding second side wall. When the cover panel is moved into the corresponding profiled members of the bottom panel or of the second side walls by means of its profiled members at the first edges, the profiled member will engage the aforesaid corresponding profiled member of the bottom panel or of the second side wall in question at a right angle, as a result of which the integrity of the container in this position (the collapsed position of the unfolded position) is further improved.

Whereas a container having four side walls has so far been discussed in the foregoing, it should be noted that it is possible within this framework for each side wall to consist of at least two side wall segments. If the side walls segments of the first side walls are provided with corresponding profiled members at their adjoining horizontal edges, for example, which profiled members can be slid into each other in their longitudinal direction, the side wall segments form smaller-scale copies of the side walls themselves, as it were. If not all the side wall segments are used, a container having a smaller height can be formed. In this way, a container is obtained whose height can be adapted to the purpose for which it is intended.

The container may furthermore be provided with quick-action couplings at its bottom panel, which are capable of effecting a connection to fixing elements present in a cargo space (such as the cargo space of an aeroplane). In this way, the container can be placed or be removed very quickly.

The container according to the invention exhibits an advantageous ratio between its collapsed volume and its fully unfolded volume. In a specific case, said ratio is 1:7. When suitable materials are used (such as the materials described in the aforesaid international patent application WO 01/05668), it is furthermore possible to realise an advantageous ratio between the container's self-weight and the weight of the useful load (in a practical application said ratio is 1:16).

One of the main advantages of the container according to the invention is its so-called multi-modal character: cargo can be transported from door to door, using different means of transport (truck, train, ship and plane) without having to repack the cargo.

BRIEF DESCRIPTION OF THE DRAWINGS

The invention will be explained in more detail hereinafter with reference to the drawing, which shows an embodiment of the container according to the invention.

DETAILED DESCRIPTION OF THE ILLUSTRATIVE EMBODIMENTS

Figure 1:
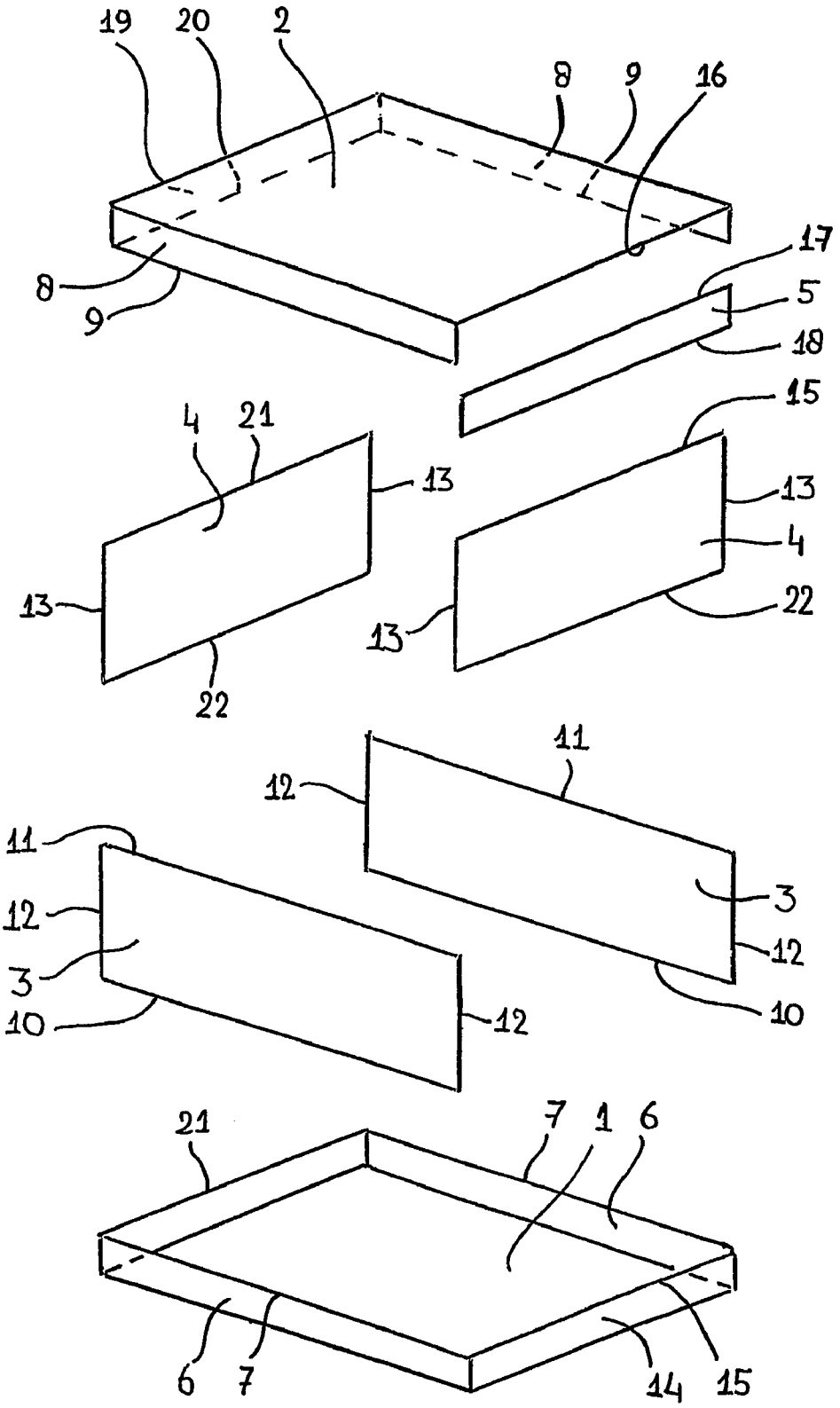
FIG. 1 is a perspective, schematic exploded view of a container according to the invention.

FIG. 1 is a perspective, exploded view, which schematically shows an embodiment of the collapsible container for the transport of air cargo according to the invention. In principle, said container consists of the following components: a bottom panel 1, a cover panel 2, two first side walls 3 and two second side walls 4. Furthermore, a locking strip 5 is shown.

Figure 2:
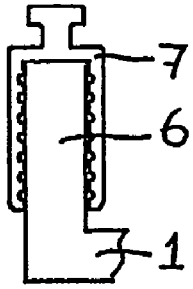
FIG. 2 is a sectional view of a profiled member.

The bottom panel 1 is provided with profiled members 7 at two opposed first edges 6 thereof, an example of which profiled members 7 is shown in the sectional view of FIG. 2. The cover panel 2 is provided with profiled members 9 at two corresponding opposed first edges 8 (see the sectional view of FIG. 3), which profiled members 9 are complementary to the profiled members 7.

Figure 3:
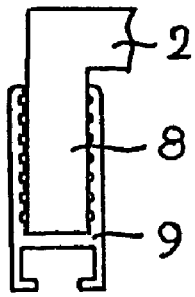
FIG. 3 is a sectional view of another profiled member.

The two opposed first side walls 3 are provided with profiled members 10 at their lower horizontal edges, which profiled members 10 correspond to the profiled members 9 of FIG. 3. Said first side walls 3 are provided with profiled members 11 at their upper horizontal edges, which profiled members 11 correspond to the profiled members 7.

At their vertical edges, the first side walls 3 are provided with profiled members 12, which correspond to the profiled members 7, for example. In that case, the corresponding vertical edges of the second side walls 4 are provided with profiled members which correspond to the profiled members 9, for example. It is also possible, however, to use different profiles for the profiled members 12 and 13, which profiles are mutually complementary, however.

The mating interaction between the complementary profiled members (in this case the mating pairs of profiled members 7 and 10, 9 and 11, 12 and 13) takes place in such a manner that said profiled members can be fitted together by being moved in longitudinal direction relative to each other.

The bottom panel 1 is provided with a profiled member 15 at a second edge 14 thereof. A corresponding second side wall 4 is provided with a corresponding profiled member 15 at its upper horizontal edge facing away from the bottom panel 1. Said profiled member 15 may be configured identically to the profiled member 7, for example.

The cover panel 2 is provided with a profiled member 16 at its corresponding lateral edge, which profiled member is configured identically to the profiled member 9, for example.

The locking strip 5 is provided with a profiled member 17 at its horizontal upper edge, which profiled member is complementary to the profiled member 16, whilst the horizontal lower edge of the locking strip 5 is provided with a profiled member 18 which is complementary to the profiled members 15 of the bottom panel 1 and the second side wall 4.

The mating interaction between the profiled members 16, 17 and 15, 18, respectively, takes place in such a manner as to allow a relative movement in longitudinal direction of the profiled members in question (during which movement the locking strip 5 is moved).

The component parts of the container that are shown in FIG. 1 can be joined into a so-called collapsed position (a position in which the volume of the container is small). In this position, the side walls 3 and 4 lie flat between the bottom panel 1 and the cover panel 2, and the cover panel 2 engages in the profiled members 7 of the bottom panel 1 with its profiled members 9. Such a position is shown in FIG. 4A, whilst in FIG. 4B the locking strip 5 is moved between the bottom panel 1 and the cover panel 2 so as to interlock the two.

Figure 4:
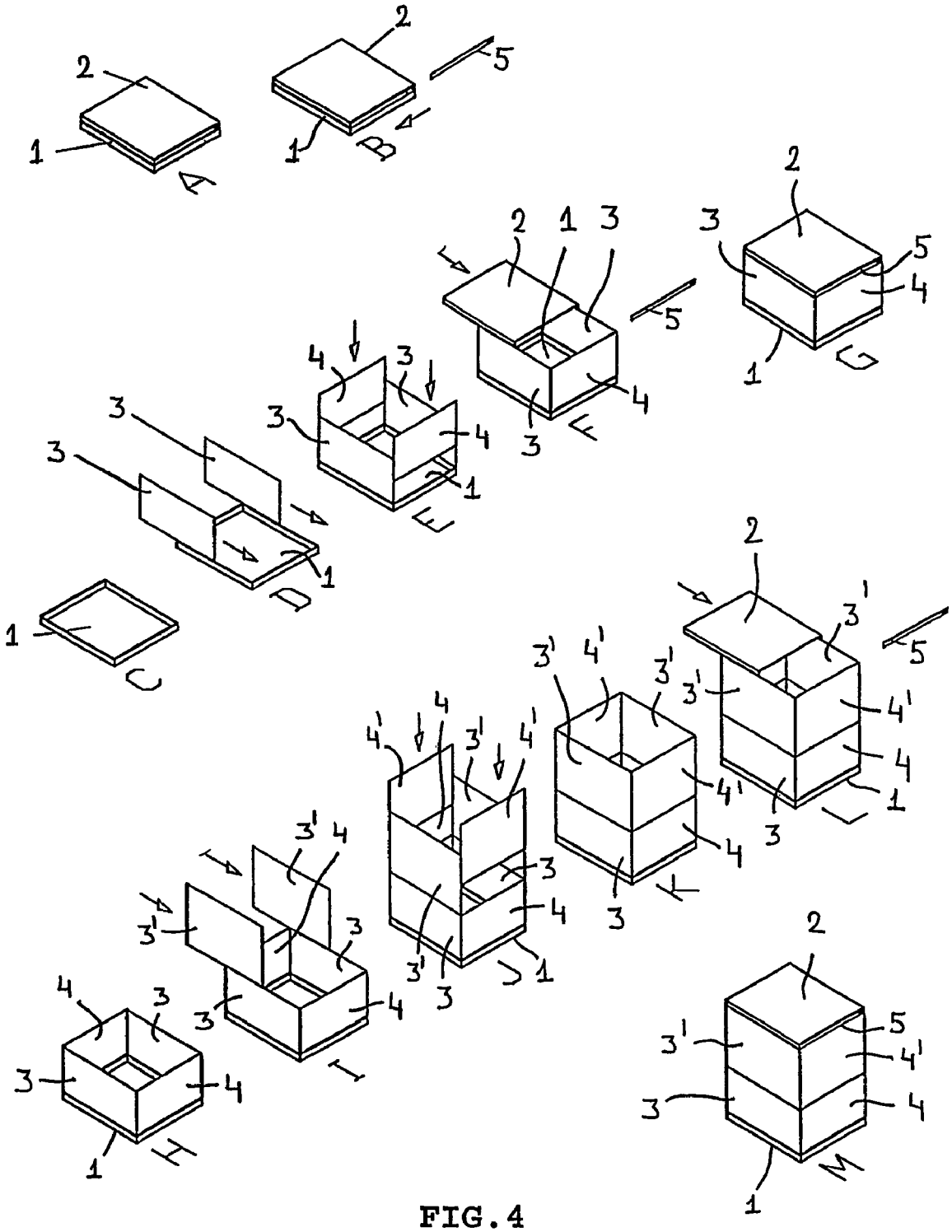
FIG. 4 shows a number of steps of the assembly of a container having a small height (A-G) and a container having a great height (H-M)

Starting from the component parts of the container that are shown in FIG. 1, the container can be brought into an unfolded position (position of use for transporting air cargo) by carrying out the steps that are shown in FIGS. 4C-4G. Starting from a bottom panel 1 (FIG. 4C), two first side walls 3 are moved onto said bottom panel 1 (FIG. 4D), in which the profiled members 7 and 10 mate and slide one into another. Then (FIG. 4E) each of the two second side walls 4 is moved between the first side walls 3 (the profiled members 12 and 13 mate during said movement). Subsequently, see FIG. 4F, the profiled members 9 of the cover panel 2 are slid into the profiled members 11 of the, first side walls 3. Finally, the locking strip 5 is inserted between the cover panel 2 and the respective second side wall 4 (in which the profiled members 15, 18 and 16, 17, respectively, mate). Thus, a container as shown in FIG. 4G is obtained.

The container that is shown in FIG. 4G has one-piece side walls 3 and 4. The side walls may also consist of two or more side wall segments, however, as a result of which a container having a greater height can be formed. Said side wall segments are suitably provided with corresponding profiled members in that case. When the situation that is shown in FIG. 4H is reached after the step that is shown in FIG. 4E has been carried out, for example, two first side walls 3' can be slid onto the first side walls 3 again (FIG. 4I), after which a next pair of second side walls 4' can be added. This results in the situation that is shown in FIG. 4K, starting from which a container having a greater height (FIG. 4M) can be obtained by shifting the cover panel 2 and adding the locking strip 5 (FIG. 4L). Depending on the selected height of the side walls 3, 4 and 3', 4', respectively, such a procedure can be repeated a number of times, until a container having a desired height is obtained. For practical reasons, the number of side wall segments of a side wall will generally not be greater than two.

Figure 5:
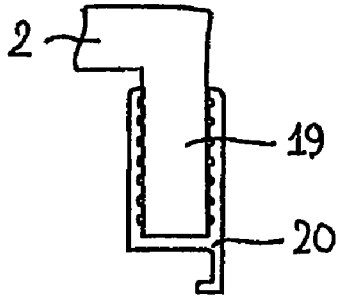
FIG. 5 is a sectional view of a hook-shaped profiled member.

In the illustrated embodiment, the cover panel 2 comprises a hook-shaped profiled member 20 (see FIG. 5) at its rear (seen in the direction of movement for unfolding the container) second edge 19 (shown on the left in FIG. 1), which is capable of engaging a corresponding profiled member 21 of the bottom panel 1 or of the corresponding second side wall 4 (see FIG. 1). In this manner an additional connection is obtained between the cover panel 2 and the bottom panel 1 or the adjoining side wall 4 in the fully collapsed position (FIG. 4A) or in a fully unfolded position (FIG. 4G or FIG. 4M).

Figure 6:
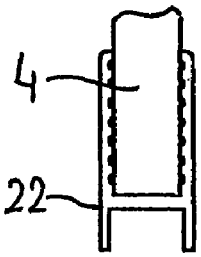
FIG. 6 is a sectional view of yet another profiled member.

Also the lower horizontal edges of the side walls 4 may be provided with profiled members 22 (for example as shown in FIG. 6), which make it possible to create a connection between said horizontal edges and the corresponding edges of the bottom panel 1 provided with the profiled members 15 and 21. The profiled member 22 can be slid over the profiled member 15 or 21 (which corresponds to the profiled member 7, for example) at right angles in that case.

Also the lower horizontal edges of the side walls 4 may be provided with profiled members 22 (for example as shown in FIG. 6), which make it possible to create a connection between said horizontal edges and the corresponding edges of the bottom panel 1 provided with the profiled members 5 and 21. The profiled member 22 can be slid over the profiled member 15 or 21 (which corresponds to the profiled member 7,4 example) at right angles in that case.

Figure 7:
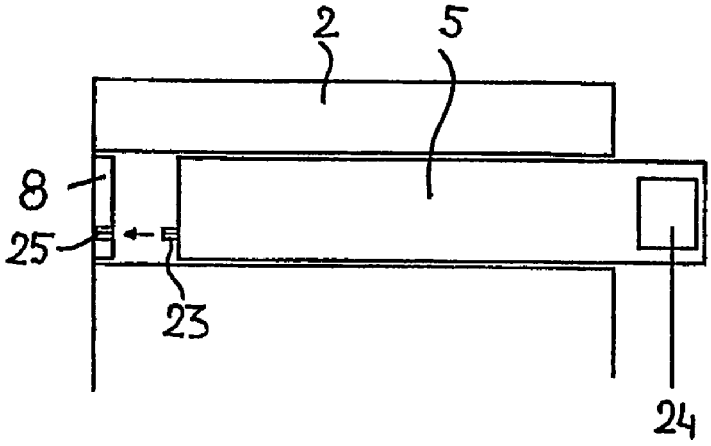
FIG. 7 shows a locking member.

Finally, reference is made to FIG. 7, which is a larger-scale view of a part of the locking strip 5. The locking strip 5 is provided with a locking mechanism comprising an operable locking pin 23. The operation of the locking pin takes place by means of a key, for example, which may also be in the form of an electronic key 24. The locking pin 23 can mate with a recess 25 in an adjacent part of the container, in this case the edge 8 of the cover panel 2. After the locking strip 5 has been moved to its correct position, the locking pin 23 is locked in position in the recess 25 by means of the electronic key 24. Only authorized persons who are in possession of the required key can remove the locking strip 5 and thus open the container.

The invention is not limited to the embodiment as described above, which can be varied in many ways within the scope of the invention as defined in the claims.

The invention claimed is:

1. A collapsible container for the transport of air cargo, comprising a bottom panel, a cover panel and four side walls which, in a position of use for enclosing air cargo, are detachably connected to said bottom panel and said cover panel, wherein the bottom panel and the cover panel adjoin each other in a collapsed position of the container, retaining the four side walls between them, and wherein the bottom panel is provided with profiled members at two opposed first edges, which profiled members can engage complementary profiled members at two corresponding opposed first edges of the cover panel by moving said profiled members in a longitudinal direction relative to each other when the container is in a collapsed position; and wherein two first opposed side walls are provided with profiled members at first and second horizontal edges, which profiled members are complementary to the corresponding profiled members of the cover panel and the bottom panel, respectively, such that in the position of use, the profiled members of the bottom panel engage the corresponding complementary profiled members of the second horizontal edge of the first side walls and the complementary profiled members of the first horizontal edge of the first side walls engage the profiled members of the cover panel, and that said first opposed side walls are provided with profiled members at their vertical edges, the profiled members on the vertical edges of the first opposed side walls engage complementary profiled members at vertical edges of two second opposed side walls by moving said profiled members in a longitudinal direction relative to each other, wherein the profiled members of the bottom panel and the first horizontal edge are the same, and the profiled members of the cover panel and the second horizontal edge are the same.

2. The container according to claim 1, and further comprising locking devices adapted to lock component parts of the container in the fully collapsed position such that there is engagement between corresponding profiled members of the bottom panel and the cover panel, or in the position of use there is engagement between corresponding profiled members of the bottom panel and the cover panel with the first side walls and engagement between corresponding profiled members of the first and the second side walls.

3. The container according to claim 2, wherein the bottom panel and one of the second side walls are provided with identical profiled members at a second edge of the bottom panel and at a first horizontal edge of said one of the second side walls facing away from the bottom panel, while the cover panel is likewise provided with a profiled member at a corresponding second edge, wherein the container further comprises a locking strip comprising corresponding, complementary profiled members which engage the profiled members of the bottom panel and the cover panel when the container is in the collapsed position, or engage the said profiled members of said one of the second side walls and the cover panel when the container is in the position of use, and wherein the locking strip includes a locking mechanism adapted to lock the locking strip in its inserted position.

4. The container according to claim 3, wherein the locking mechanism comprises a locking pin to be operated by a key, which, in a locking position, effects a connection between the locking strip and an adjacent part of the container.

5. The container according to claim 4, wherein the cover panel is provided with a profiled member at a rear second edge, which profiled member is capable of hooked engagement with a corresponding profiled member of the bottom panel or of a first horizontal edge of a second side wall opposed to said one of the second side wall when the container is in a position of use.

6. The container according to claim 5, wherein the side walls each comprise at least two side wall segments.

7. The container according to claim 1, wherein the bottom panel includes quick-action couplings.

8. The container according to claim 1, wherein the cover panel is provided with a profiled member at a rear second edge, which profiled member is capable of hooked engagement with a corresponding profiled member of the bottom panel or of a first horizontal edge of one of the second side walls.

9. The container according to claim 2, wherein the cover panel is provided with a profiled member at a rear second edge, which profiled member is capable of hooked engagement with a corresponding profiled member of the bottom panel or of the a first horizontal edge of one of the second side walls.

10. The container according to claim 3, wherein the cover panel is provided with a profiled member at a rear second edge, which profiled member is capable of hooked engagement with a corresponding profiled member of the bottom panel or of a first horizontal edge of a second side wall opposed to said one of the second side walls when the container is in a position of use.

11. The container according to claim 1, wherein the side walls each comprise at least two side wall segments.

12. The container according to claim 2, wherein the side walls each comprise at least two side wall segments.

13. The container according to claim 3, wherein the side walls each comprise at least two side wall segments.

14. The container according to claim 4, wherein the side walls each comprise at least two side wall segments.

15. A collapsible container for the transport of air cargo, comprising:

a bottom panel:

a cover panel: and four side walls which are detachably connected to said bottom panel and said cover panel, wherein the bottom panel and the cover panel adjoin each other in a collapsed position of the container, retaining the four side walls between them, wherein the bottom panel is provided with profiled members at two opposed first edges, which profiled members can engage complementary profiled members at two corresponding opposed first edges of the cover panel by moving said profiled members in a longitudinal direction relative to each other; and wherein two first opposed side walls are provided with profiled members at first and second horizontal edges, which profiled members are complementary to the corresponding profiled members of the bottom panel and the cover panel, and in that said first opposed side walls are provided with profiled members at their vertical edges, which profiled members engage complementary profiled members at the corresponding vertical edges of two second opposed side walls by moving said profiled members in a longitudinal direction relative to each other; and locking devices adapted to lock component parts of the container in the fully collapsed position such that there is engagement between corresponding profiled members of the bottom panel and the cover panel, or in the position of use there is engagement between corresponding profiled members of the bottom panel and the cover panel with the first side walls and engagement between corresponding profiled members of the first and the second side walls, wherein the bottom panel and one of the second side walls are provided with identical profiled members at a second edge of the bottom panel and at a first horizontal edge of said one of the second side walls facing away from the bottom panel, while the cover panel is likewise provided with a profiled member at a corresponding second edge, wherein the container further comprises a locking strip comprising corresponding, complementary profiled members engagable with the said profiled members of the bottom panel and the cover panel when the container is in the collapsed position, or engage the said profiled members of said second side wall and the cover panel when the container is in the position of use, and wherein the locking strip includes a locking mechanism adapted to lock the locking strip in its inserted position.

16. The container according to claim 15, wherein the locking mechanism comprises a locking pin to be operated by a key, which, in a locking position, effects a connection between the locking strip and an adjacent part of the container.

17. The container according to claim 16, wherein the cover panel is provided with a profiled member at a rear second edge, which profiled member is capable of hooked engagement with a corresponding profiled member of the bottom panel or of a first horizontal edge of a second side wall opposed to said one of the second side walls when the container is in the position of use.

18. The container according to claim 17, wherein the side walls each comprise at least two side wall segments.

19. A collapsible container for the transport of air cargo, comprising:

a bottom panel:

a cover panel: and four side walls which are detachably connected to said bottom panel and said cover panel, wherein the bottom panel and the cover panel adjoin each other in a collapsed position of the container, retaining the four side walls between them, wherein the bottom panel is provided with profiled members at two opposed first edges, which profiled members can engage complementary profiled members at two corresponding opposed first edges of the cover panel by moving said profiled members in a longitudinal direction relative to each other; and wherein two first opposed side walls are provided with profiled members at first and second horizontal edges, which profiled members are complementary to the corresponding profiled members of the bottom panel and the cover panel, and in that said first opposed side walls are provided with profiled members at their vertical edges, which profiled members can engage complementary profiled members at the corresponding vertical edges of two second opposed side walls by moving said profiled members in a longitudinal direction relative to each other, and wherein the cover panel is provided with a profiled member at a rear second edge, which profiled member is capable of hooked engagement with a profiled member of the bottom panel or of a first horizontal edge of one of the second side walls.

* * * * *